US007111680B2

(12) United States Patent
Duggan

(10) Patent No.: US 7,111,680 B2
(45) Date of Patent: Sep. 26, 2006

(54) BORE-LINING TUBING AND METHOD OF USE

(75) Inventor: Andrew Michael Duggan, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 337 days.

(21) Appl. No.: 10/601,405

(22) Filed: Jun. 23, 2003

(65) Prior Publication Data

US 2004/0031530 A1 Feb. 19, 2004

(30) Foreign Application Priority Data

Jun. 29, 2002 (GB) ..... 0215107.4

(51) Int. Cl.
*E21B 23/02* (2006.01)

(52) U.S. Cl. ..... 166/207; 166/206; 166/382; 166/384; 166/242.1; 166/242.2

(58) Field of Classification Search ..... 166/206, 166/207, 382, 384, 242.1, 242.2, 242.3
See application file for complete search history.

(56) References Cited

U.S. PATENT DOCUMENTS

| | | | | |
|---|---|---|---|---|
| 1,233,888 | A | 7/1917 | Leonard | |
| 6,446,724 | B1 * | 9/2002 | Baugh et al. | 166/285 |
| 6,598,678 | B1 * | 7/2003 | Simpson et al. | 166/297 |
| 6,648,075 | B1 * | 11/2003 | Badrak et al. | 166/381 |
| 6,655,459 | B1 | 12/2003 | Mackay | |
| 6,688,400 | B1 | 2/2004 | Metcalfe et al. | |
| 6,725,917 | B1 | 4/2004 | Metcalfe | |
| 6,845,820 | B1 | 1/2005 | Hebert et al. | |
| 6,920,934 | B1 | 7/2005 | Badrak et al. | |
| 2002/0079101 | A1 | 6/2002 | Baugh et al. | 166/285 |
| 2003/0127225 | A1 | 7/2003 | Harrall et al. | |

FOREIGN PATENT DOCUMENTS

| | | |
|---|---|---|
| EP | 952306 A1 * | 10/1999 |
| GB | 2 345 308 | 7/2000 |
| WO | WO 99/35368 | 7/1999 |
| WO | WO02/29199 | 4/2002 |

OTHER PUBLICATIONS

PCT International Search Report, International Application No. PCT/GB 03/02754, dated Oct. 27, 2003.
British Search Report dated Sep. 18, 2002, for application No. GB0215107.4.

* cited by examiner

*Primary Examiner*—David Bagnell
*Assistant Examiner*—Giovanna M. Collins
(74) *Attorney, Agent, or Firm*—Patterson & Sheridan, LLP

(57) ABSTRACT

There is disclosed a method of lining a drilled bore (10) and bore-lining tubing (12).

The method comprises providing a first tubular (16); locating the first tubular (16) in the bore (10); providing an expandable, second tubular (22); locating the second tubular (22) in the bore (10) overlapping the first tubular (16); expanding a portion (24) of the second tubular (22) to create a coupling (29) including a flow passage (26) between the first tubular and the second tubular (16,22).

76 Claims, 9 Drawing Sheets

BORE-LINING TUBING AND METHOD OF USE

BACKGROUND OF THE INVENTION

1. Field of the Invention

This invention relates to bore-lining tubing and to a method of lining a drilled bore.

2. Background of the Invention

Expandable downhole tubulars are being used increasingly in the oil and gas exploration and production industry.

It is amongst the objects of embodiments of the present invention to provide downhole tubing which facilitates the hanging and cementing of an expandable liner.

SUMMARY OF THE INVENTION

According to a first aspect of the present invention, there is provided a method of lining a drilled bore, the method comprising the steps of:

providing a first tubular;

locating the first tubular in a bore;

providing an expandable, second tubular;

locating the second tubular in the bore overlapping the first tubular;

expanding a portion of the second tubular to create a coupling including a flow passage between the first tubular and the second tubular.

Preferably, the method also comprises:

providing the first tubular with a profiled portion describing an internal diameter; providing the expandable, second tubular with an external diameter less than the internal diameter of the first tubular; and locating the second tubular in the bore overlapping the profiled portion of the first tubular.

The portion of the second tubular may be expanded into contact with the first tubular to create the coupling. An upper end portion of the second tubular may be expanded into contact with the first tubular.

Preferably also, the method further comprises flowing fluid via said flow passage; and then sealing the second tubular to the first tubular.

The expansion of the second tubular is intended to prevent or at least minimise relative movement between the first and second tubulars, and preferably creates a hanging support for the second tubular.

Preferably, the first tubular has a profiled lower end portion.

Preferably, the method further comprises circulating cement into the annulus between the second tubular and the bore wall and displacing fluid from the annulus via the flow passage.

Preferably, the method further comprises expanding the second tubular below the coupling whilst maintaining said flow passage open, and most preferably expanding the second tubular to substantially the same internal diameter as the first tubular. This allows cementation to be carried out after the second tubular has been expanded, and also allows for top down expansion of the second tubular.

Sealing the second tubular to the first tubular may close the flow passage. The second tubular may be sealed to the first tubular by expanding part of the upper end portion of the second tubular located above said profiled lower end portion into sealing contact with a wall of the first tubular. Accordingly, the second tubular may be located in the bore such that it overlaps the profiled lower end portion and extends partly into an unprofiled portion of the first tubular.

Alternatively, the second tubular may be sealed to the first tubular by expanding part of the upper end portion Of the second tubular located below said profiled lower end portion into sealing contact with a wall of the first tubular. Accordingly, the first tubular may include an unprofiled part below the profiled lower end portion against which the second tubular may be sealed.

The upper end portion of the second tubular may be expanded to an internal diameter substantially equal to the internal diameter of the first tubular. This allows full bore access without any restriction in the bore caused by the coupling. This may be achieved by providing a first tubular having a profiled lower end portion of an internal diameter greater than the internal diameter of a remainder of the first tubular, to accommodate expansion of the second tubular.

In an alternative, the second tubular may be sealed to the first tubular by deforming one or both of the first and second tubulars. In one embodiment, the second tubular may be sealed to the first tubular by deforming the profiled lower end portion of the first tubular. This may be achieved by corrugating, shaping or otherwise profiling said lower end portion, such that when the second tubular is expanded, it is urged radially outwardly to deform the profiled lower end portion of the first tubular.

Preferably, the second tubular is expanded from the top-down, from a level below the coupling downwards. This maintains the flow passage open and avoids problems of expansion affecting the coupling and of retrieval of expansion tools.

It will be understood that the lower end of the first tubular is profiled in that it is of non-circular internal section, and includes one or more, in particular a plurality of axial or helical flutes, grooves, channels, cutouts or the like.

The first tubular may be profiled prior to location of the second tubular in the bore. The first tubular may be profiled to shape the tubular in such a fashion that a flow passage is created on expansion of the second tubular. Thus, it will be understood that reference herein to profiling a tubular is to carrying out a shaping procedure on the tubular.

The second tubular may additionally or alternatively be profiled following location in the bore. The second tubular may be profiled on expansion. Alternatively, the second tubular may be expanded and then profiled. This may be achieved in a single procedure or in two separate procedures.

The first tubular may be profiled following location in the bore and prior to location of the second tubular, and then at least part of the second tubular may be profiled, optionally on expansion.

According to a second aspect of the present invention, there is provided bore-lining tubing comprising:

a first tubular;

an expandable, second tubular; and a coupling between an expanded portion of the second tubular and the first tubular, said coupling including at least one flow passage between the first tubular and the second tubular.

Preferably, the first tubular of the bore-lining tubing includes a profiled portion; and the expandable, second tubular extends from the first tubular and overlaps the profiled portion. The coupling may be formed between an upper end portion of the second tubular expanded into contact with the profiled portion of the first tubular. Preferably, the flow passage is for the flow of fluid via said passage.

The provision of bore-lining tubing including a flow passage allows the tubing to be set in the bore and cemented after expansion of the second tubular.

Preferably, the first tubular profiled portion comprises a profiled lower end portion. Alternatively, the profiled portion may be provided at any desired location along a length of the first tubular.

The second tubular may be expanded at a level below the coupling. Preferably, the second tubular is expanded to an internal diameter substantially equal to an internal diameter of the first tubular. Preferably also, the expandable, second tubular comprises an expandable solid tubular.

An inner wall of the profiled lower end portion of the first tubular may include at least one flute, groove, channel or cutout defining said flow passage. Preferably, the profiled lower end portion includes a plurality of flutes, grooves, channels or cutouts around the internal circumference of the tubular, each defining a separate flow passage between the first and second tubulars. The (or each) flute, groove, channel or cutout may extend substantially axially or helically around the inner wall of the profiled lower end portion.

The internal diameter of the profiled lower end portion of the first tubular may be less than an internal diameter of the remainder of the first tubular. Alternatively, said internal diameter may be greater than an internal diameter of the remainder of the first tubular. In this fashion, when the upper end portion of the second tubular is expanded, the bore lining tubing may define a "monobore", that is, of a substantially constant diameter along the length thereof. Thus the profiled lower end portion of the first tubular may also be of an external diameter greater than the external diameter of the remainder of the first tubular. This may maintain wall thickness and thus integrity of the first tubular in the region of the profiled lower end portion.

The profiled lower end portion of the first tubular may be profiled internally and externally and may, for example, be corrugated or otherwise shaped, and deformable to allow said flow passage to be closed by expansion of the second tubular. This may urge the second tubular outwardly, to in-turn expand the profiled lower end portion of the first tubular.

According to a third aspect of the present invention, there is provided bore-lining tubing comprising a first tubular adapted to receive an expandable, second tubular therein and to have a portion of the second tubular expanded into contact with the first tubular, to define at least one flow passage therebetween.

Preferably, the first tubular of the bore-lining tubing includes a profiled portion adapted to have the portion of the expandable, second tubular expanded into contact with said profiled portion. The profiled portion of the first tubular may be adapted to have an upper end portion of the expandable, second tubular expanded into contact with said profiled portion.

According to a fourth aspect of the present invention, there is provided bore-lining tubing comprising a tubular having a profiled portion defining at least one flow passage extending along the profiled portion.

BRIEF DESCRIPTION OF THE DRAWINGS

Embodiments of the present invention will now be described, by way of example only, with reference to the accompanying drawings in which.

DETAILED DESCRIPTION OF THE PREFERRED EMBODIMENT

Figure 1A:
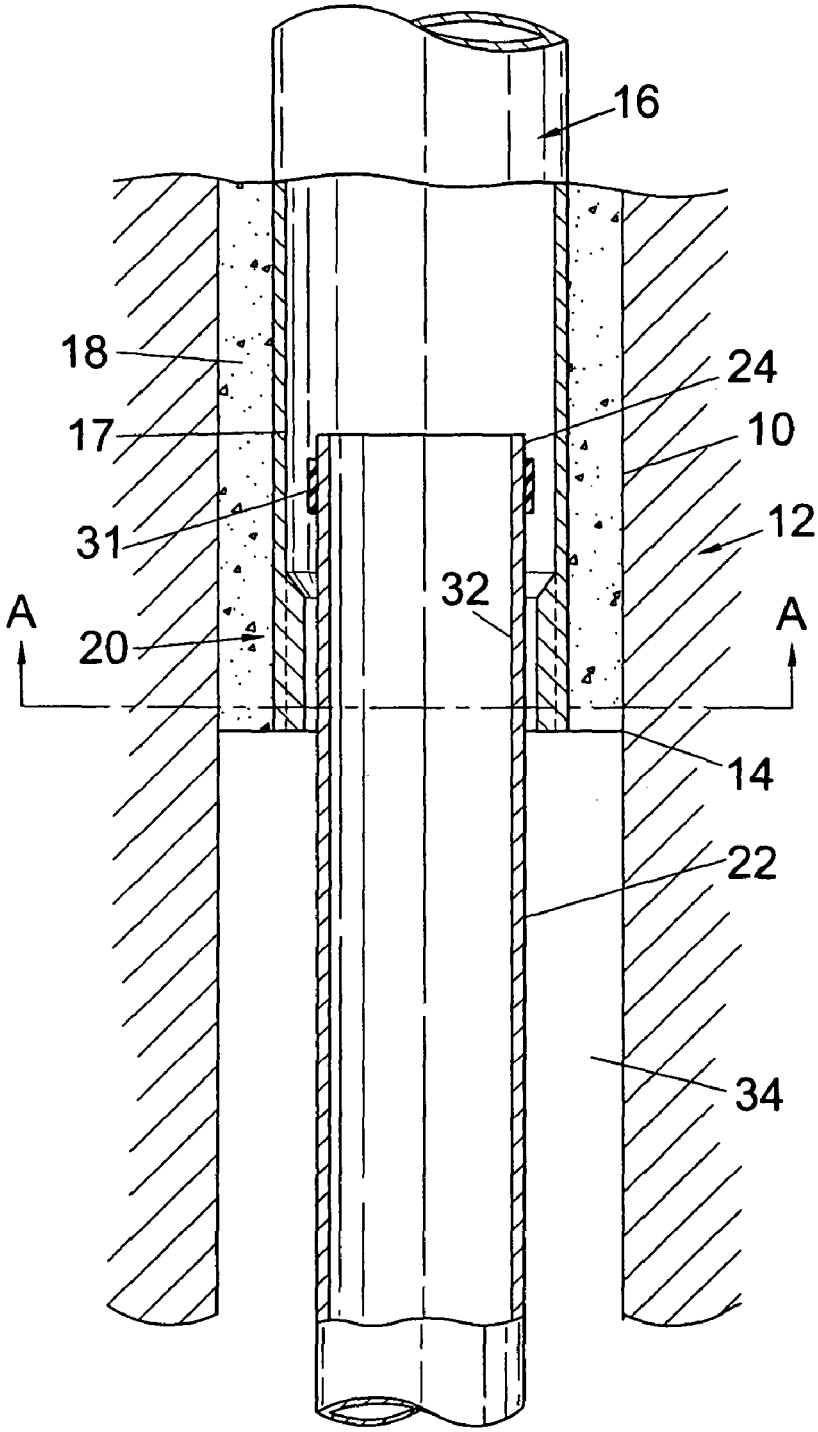
FIG. 1A is a schematic cross-sectional view of a bore lined with bore-lining tubing in accordance with a first embodiment of the present invention, showing a first tubular in the bore and a second expandable tubular located within the first tubular.

Referring firstly to FIG. 1A, there is shown a schematic cross-sectional view of a bore 10 lined with bore-lining tubing in accordance with a first embodiment of the present invention, indicated generally by reference numeral 12. The bore 10 has been drilled from surface to a depth 14, in a fashion known in the art, and cased to this level with a first tubular in the form of borehole casing 16, cemented at 18. The borehole casing 16 comprises a number of sections coupled together to form a casing string, and a lower section 17 is shown in the Figures. The section 17 includes a profiled portion in the form of profiled lower end portion 20. The bore 10 is then extended to a desired depth by drilling from the level 14 and/or drilling followed by underreaming the bore 10 to a determined internal diameter.

The bore-lining tubing 12 also includes an expandable, second tubular in the form of an expandable liner 22. The liner 22 is run-in from surface and located such than an upper end portion 24 of the liner 22 overlaps the profiled lower end portion 20 of the lower casing section 17.

Figure 1B:
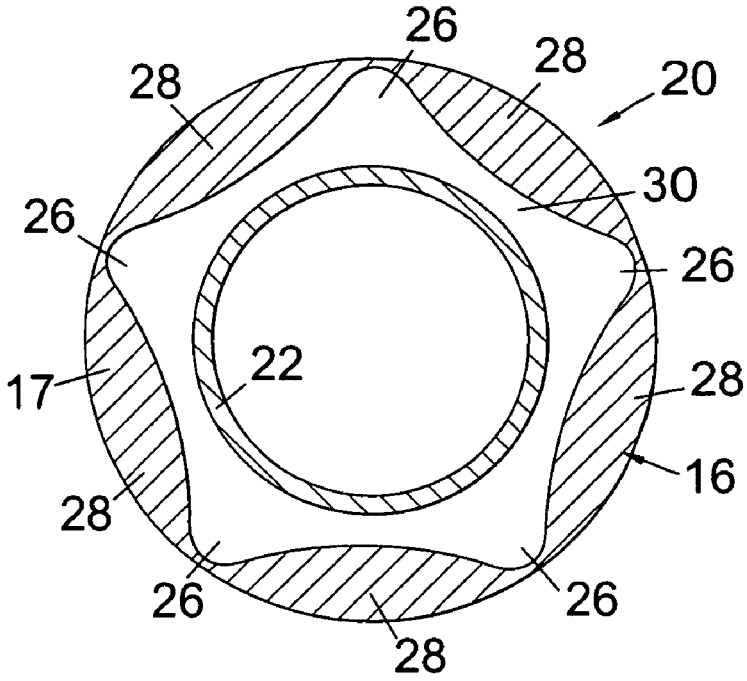
FIG. 1B is a cross-sectional view of the bore-lining tubing taken in the direction of line A—A of FIG. 1A.

FIG. 1B is a cross-sectional view of the bore-lining tubing 12 taken on line A—A of FIG. 1A. The profiled lower end 20 of the lower casing section 17 includes a number of axial flutes, spaces or other means defining a by-pass 26 between thickened wall portions 28. In the tubing configuration of FIGS. 1A and 1B, there is an annular clearance 30 between the liner 22 and the thickened portions 28.

Figure 2A:
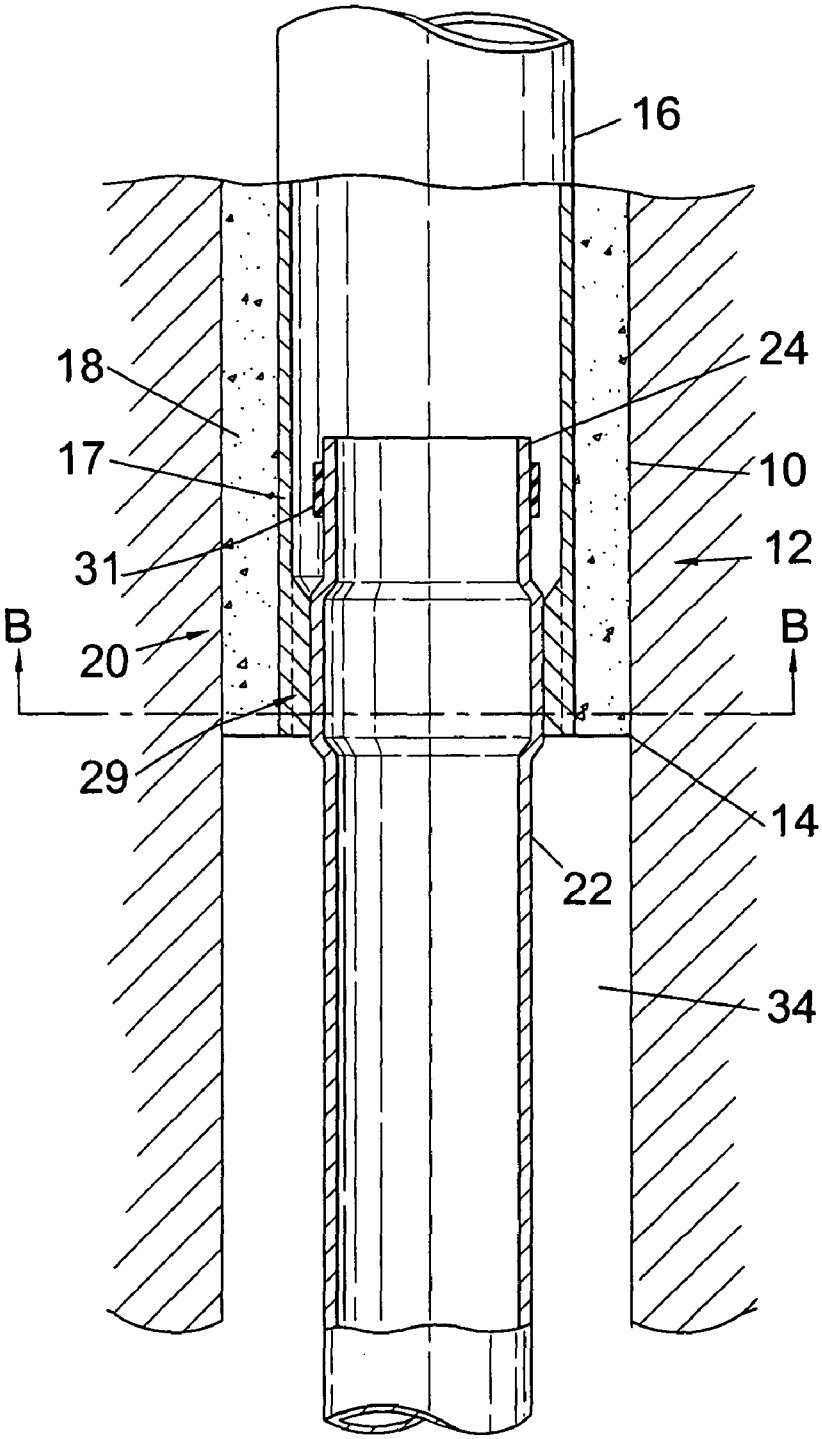
FIG. 2A is a view of the bore-lining tubing of FIG. 1A, showing the second tubular partially expanded into contact with the first tubular.
Figure 2B:
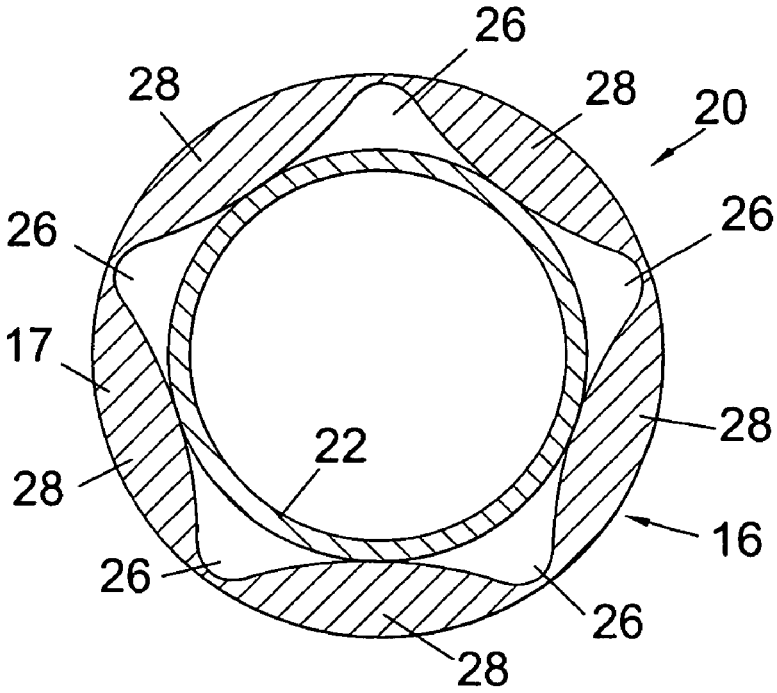
FIG. 2B is a cross-sectional view of the bore-lining tubing taken in the direction of line B—B of FIG. 2A.

An expansion device is then activated, to expand an area 32 of the liner upper end portion 24 into contact with the thickened portions 28, as shown in the view of FIG. 2A, and the cross-sectional view of FIG. 2B, taken on line B—B of FIG. 2A. This provides a secure coupling 29 between the liner 22 and the casing 16, from which the liner 22 may then be suspended. Significantly, the flutes/spaces 26 in the profiled lower end of the casing 16 are kept open and define one or more flow passages between the profiled lower end 20 and the liner 22. This allows fluid flow between the first and second tubulars 16 and 22, from the bore 10, through the coupling 29 and into the casing 16.

Figure 3:
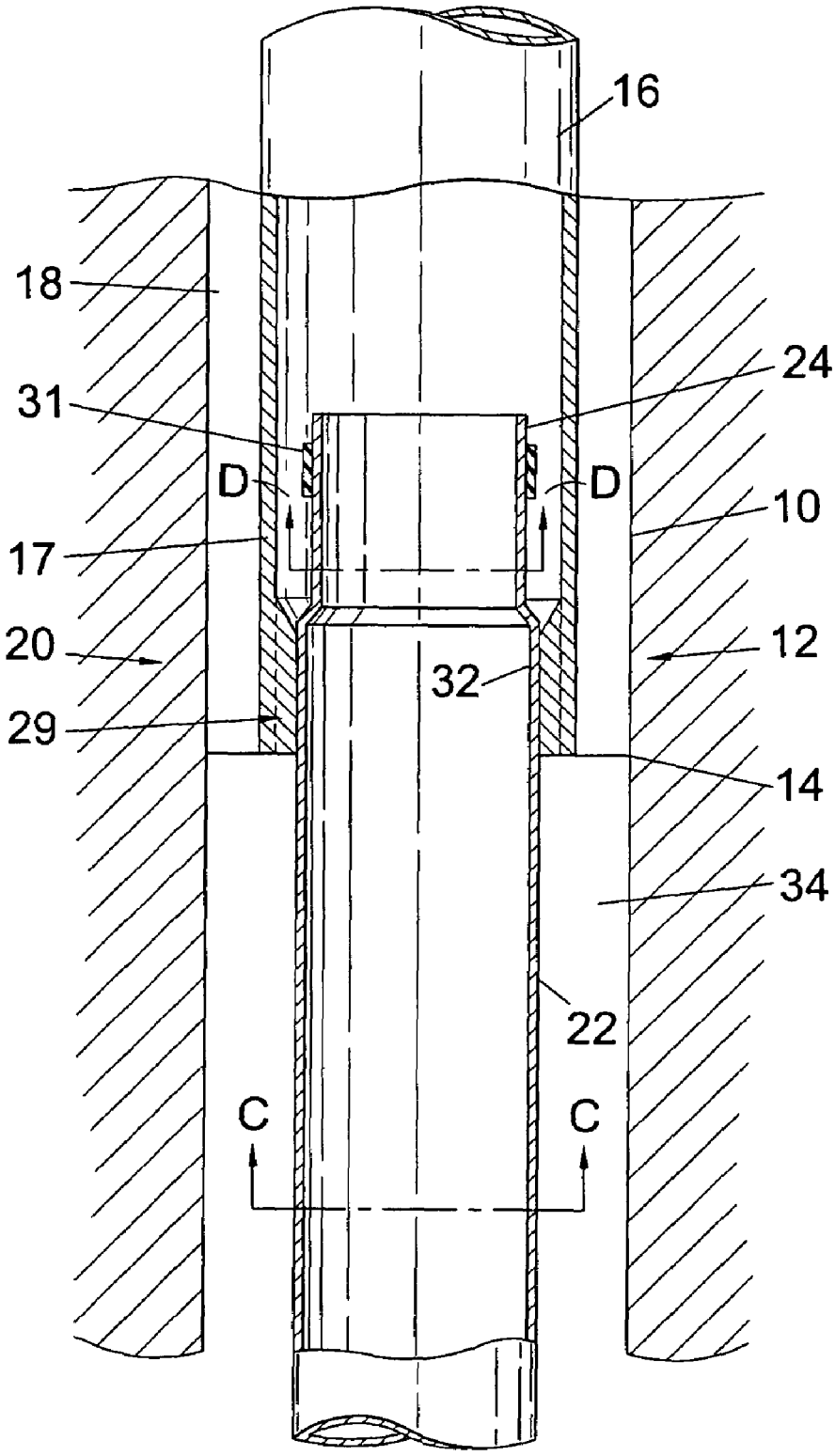
FIG. 3 is a view of the bore-lining tubing of FIG. 1A, showing a lower part of the second tubular fully expanded.

The expansion device is then run through the section of liner 22 below the joint to expand the liner 22 out to the same internal diameter as the area 32, as shown in FIG. 3. During this expansion procedure, the flow passages 26 are maintained open. Following this expansion, cement is pumped from surface down through the casing 16, and through a cement shoe (not shown) at the bottom of the liner 22. The cement passes up through the annulus 34 defined between the bore 10 wall and the liner 22, in the direction of the arrow C. Fluid displaced from the annulus 34 by the cement is circulated through the flow passages 26 in the coupling 29 and between the tubulars 16 and 22, in the direction of the arrow D. Accordingly, this allows expansion of the liner 22 before the cementing process is undertaken and thus avoids the problems of the art.

Figure 4:
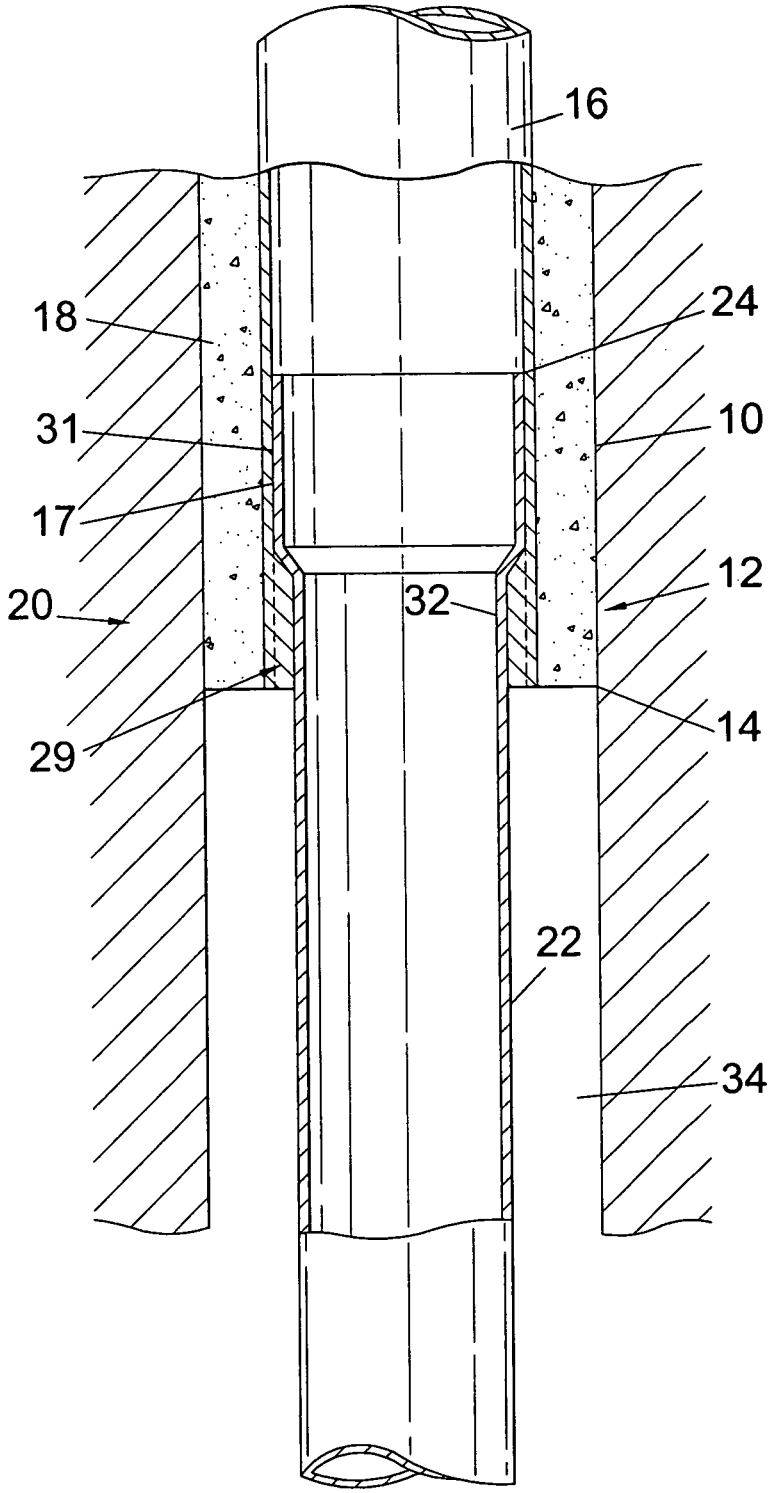
FIG. 4 is a view of the bore-lining tubing of FIG. 1A, showing the second tubular fully expanded.

After cementing has been completed, the expansion tool is re-run through the liner 22, to expand the upper end portion 24 above (and/or a portion below) the coupling 29 outwardly, into engagement with the casing 16, as shown in FIG. 4. This expansion of the liner 22 into contact with the casing 16 above and/or below the coupling closes the flow passages 26, and the liner 22 is sealed to the casing 16 by an elastomeric or other deformable seal sleeve 31 located around the upper end portion 24 of the liner 22. Also, the flow passages 26 are further sealed by any cement remaining in the passages. The bore 10 has then been fully lined and sealed to a desired depth.

Figure 5:
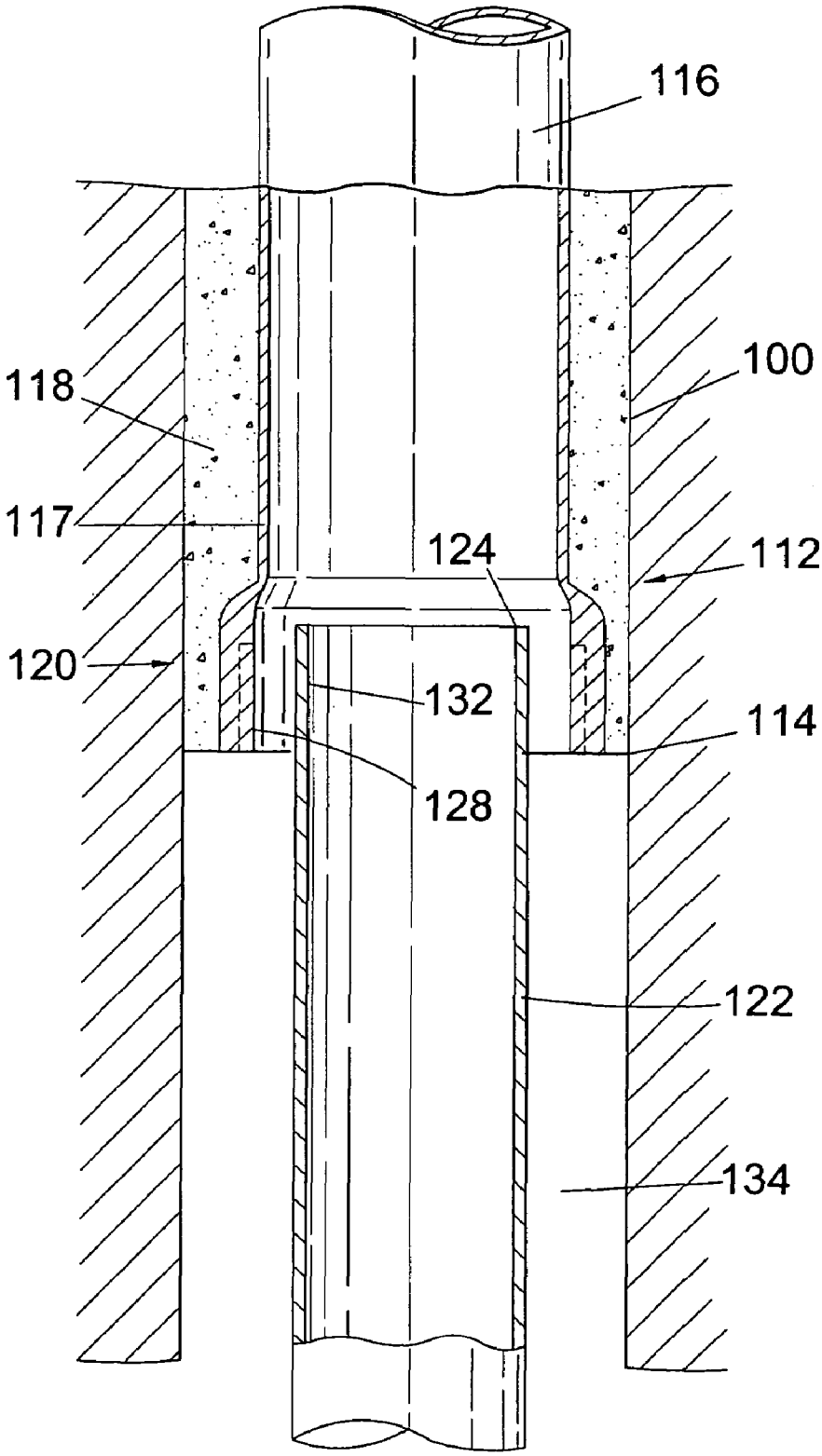
FIG. 5 is a view of a bore-lining tubing in accordance with an alternative embodiment of the present invention.

FIG. 5 shows an alternative embodiment of the present invention, with bore-lining tubing indicated generally by reference numeral 112 located in a bore 100. Like components of the bore-lining tubing 112 with the tubing 12 of FIGS. 1–4 share the same reference numerals incremented by 100.

The bore-lining tubing 112 and the method for expanding and cementing the tubing is substantially the same as that described with reference to FIGS. 1–4. However, the bore-lining tubing 112 differs in that the lower end of the borehole casing 116 includes a different profiled lower end portion 120. As shown in FIG. 5, the internal diameter between the thickened portions 128 of the lower end portion 120 is greater than the internal diameter of the remainder of the casing 16. In this fashion, when the area 132 of the liner 122 is expanded into contact with the profiled lower end portion 120 (in a procedure corresponding to that shown in FIG. 2A), the joint between the tubulars does not restrict the bore and the expanded liner 122 has an internal diameter equal to that of the casing 16. This allows full bore access after completion of the procedure.

Figure 6A:
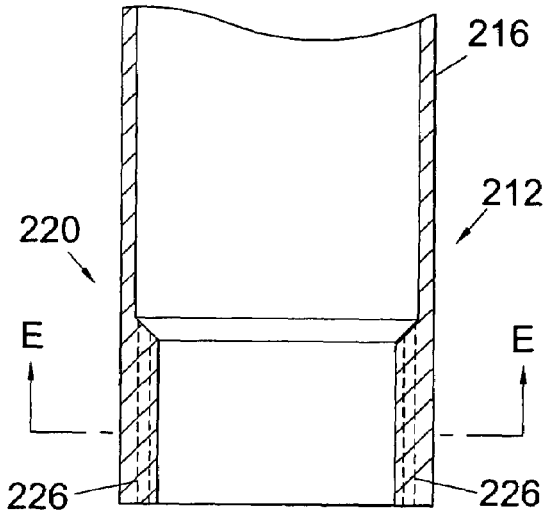
FIG. 6A is a schematic, cross-sectional view of part of a bore-lining tubing in accordance with a further alternative embodiment of the present invention.

FIG. 6A shows a further alternative embodiment of the present invention, illustrating part of a bore lining tubing indicated generally by reference numeral 212. Like components of the bore lining tubing 212 with the tubing 12 of FIGS. 1–4 share the same reference numerals incremented by 200. In the figure, only the borehole casing 216 is shown, for ease of reference. However, a liner such as the liners 22, 122 described above with reference to FIGS. 1 to 5 is typically coupled to the casing.

Figure 6B:
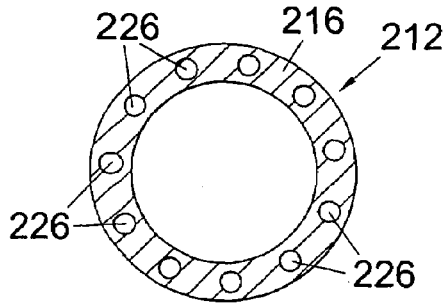
FIG. 6B is a cross-sectional view of the bore-lining tubing taken in the direction of line E—E of FIG. 6A.

The bore lining-tubing 212 and the method for expanding and cementing the tubing is substantially the same as that described with reference to FIGS. 1–4. However, the borehole casing 216 includes enclosed flow passages 226, as best shown in the cross-sectional view of FIG. 6B, taken on line E—E of FIG. 6A. The flow passages 226 extend through the profiled lower end portion 220 of the borehole casing 216, to allow fluid flow from the borehole annulus surrounding the liner into the casing 216 until the flow passages are closed or isolated as described above.

Figure 7:
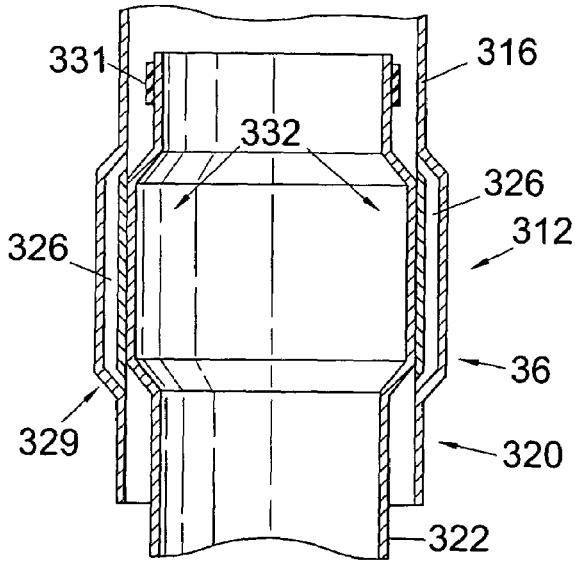
FIG. 7 is a schematic, cross-sectional view of a bore-lining tubing in accordance with a still further alternative embodiment of the present invention.

FIG. 7 shows a still further alternative embodiment of the present invention, illustrating bore lining tubing indicated generally by reference numeral 312. Like components of the bore-lining tubing 312 with the tubing 12 of FIGS. 1–4 share the same reference numerals incremented by 300.

The borehole casing 316 includes a profiled lower end portion 320 which comprises a relatively thick-walled portion 36 that defines an upset on the casing.

Flow passages 326 are spaced circumferentially around the upset 36, and extend axially through the upset 36. A liner 322 is located in the casing 316, with an area 332 expanded into contact with the casing 316 to create a hanging support. In this position, the flow passages 326 remain open to allow fluid circulation for subsequent cementation. The flow passages 326 are then isolated by expanding the liner 322 above the coupling 329, as described above.

Figure 8:
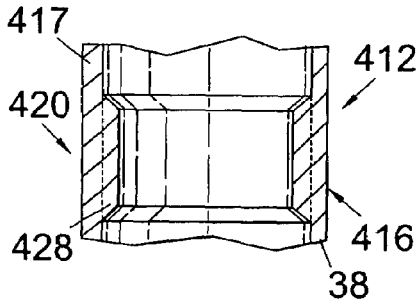
FIG. 8 is schematic, cross-sectional view of part of a bore-lining tubing in accordance with a still further alternative embodiment of the present invention.

FIG. 8 shows a still further alternative embodiment of the present invention, illustrating part of a bore lining tubing indicated generally by reference numeral 412. Like components of the bore lining tubing 412 with the tubing 12 of FIGS. 1–4 share the same reference numerals incremented by 400. In the Figure, only the borehole casing 416 is shown, for ease of reference. However, a liner such as the liners 22, 122 or 322, described above with reference to FIGS. 1 to 7, is typically coupled to the casing.

The borehole casing 416 is substantially similar to the casings 16, 116, 216 described above, except that the profiled lower end portion 420 comprises relatively thick-walled portions 428 defining axial flutes or the like, similar to the casing 16. However, the thick-walled portions 428 are located above a lowermost end 38 of the lower casing section 417 shown in the figure. In a further alternative, the profiled lower end portion 420 comprises enclosed flow passages, similar to the flow passages 226, 0326 of FIGS. 6A to 7.

Figure 9:
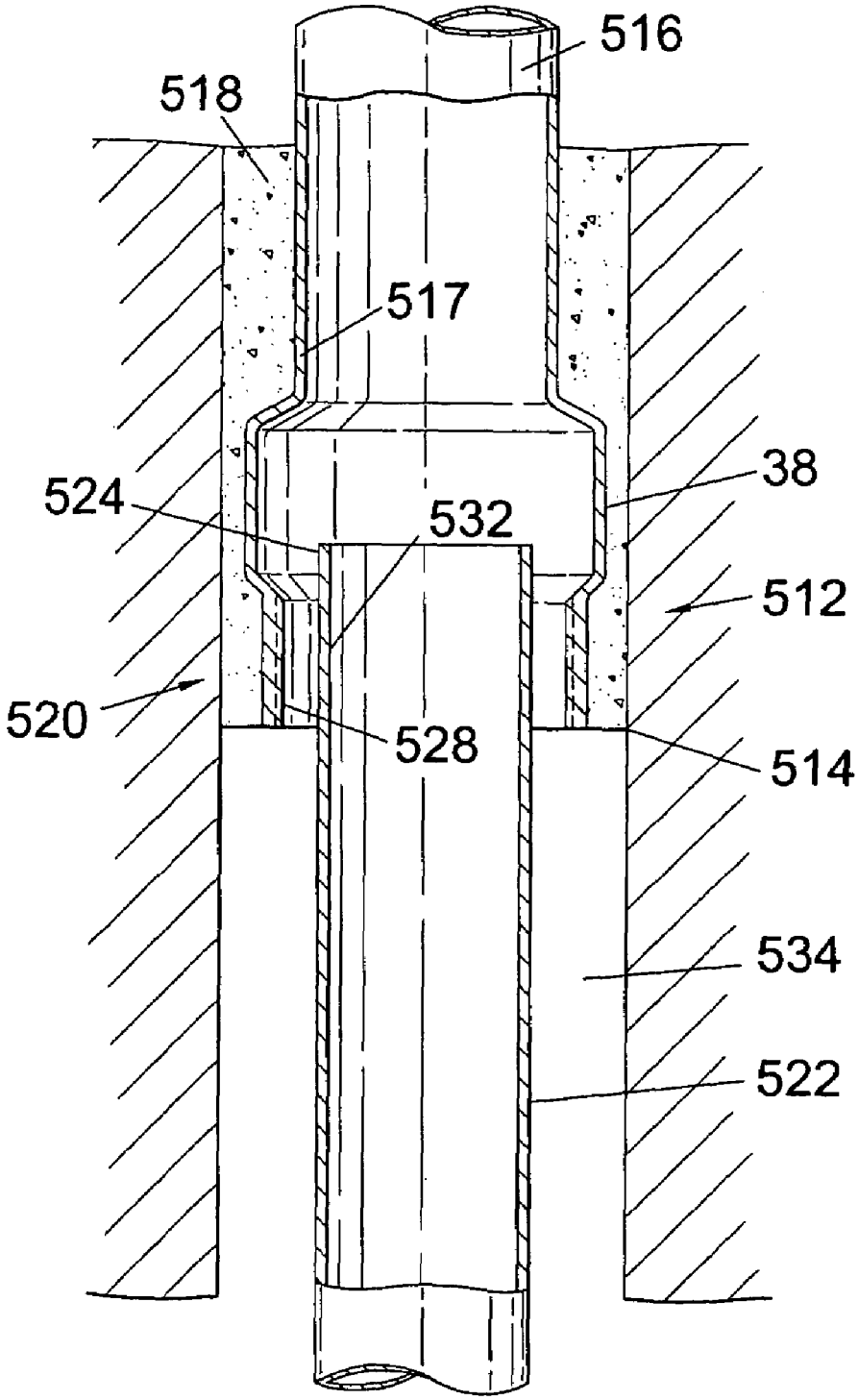
FIG. 9 is a view of a bore-lining tubing in accordance with a further alternative embodiment of the present invention.

FIG. 9 shows a yet further alternative embodiment of the present invention, illustrating part of a bore lining tubing indicated generally by reference numeral 512. Like components of the bore lining tubing 512 with the tubing 12 of FIGS. 1–4 share the same reference numerals incremented by 500.

The bore lining tubing 512 is similar to the tubing 112 of FIG. 5 in that the minimum internal diameter of the lower end portion 520 is greater than the internal diameter of the remainder of the casing 516, to accommodate the expanded liner 522. Thus when the liner 522 is expanded in the area 532 into contact with the profiled lower end portion 520 of the casing 516, the joint between the tubulars does not restrict the bore, as the expanded liner 522 has an internal diameter equal to that of the casing 516. This initial expansion of the liner 522 creates a hanging support, in a similar fashion to the liner 22, as shown in FIG. 2A, and the liner 522 is then expanded downwardly below the joint between the tubulars. Following such expansion, a larger diameter portion 38 of the casing section 517 above the profiled lower end portion 520 allows fluid flow through the flow passages then formed between the casing 516 and the liner 522, and cement is then circulated through the liner 522 into the annulus 534. The flow passages are then closed by further expanding the upper end 524 of the liner 522 into contact with the inner wall of the larger diameter portion 38.

Figure 10:
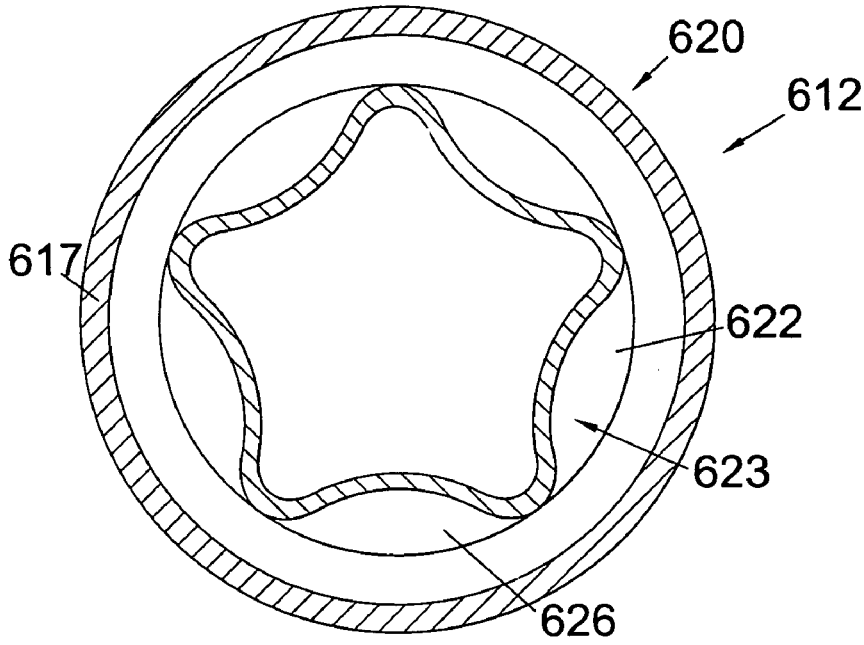
FIG. 10 is a cross-sectional view of bore-lining tubing in accordance with a still further alternative embodiment of the present invention.

Turning now to FIG. 10, there is shown a cross-sectional view of bore-lining tubing in accordance will a still further alternative embodiment of the present invention, the tubing indicated generally by reference numeral 612.

In the Figure, the lower end 620 of a lower casing section 617 is shown with a liner 622 located within the section 617, in a similar fashion to the liner 22 of FIGS. 1A–4. However, the liner 622 includes a profiled portion 623, typically at an upper end of the liner, such that the liner is profiled both internally and externally in the region of the portion 623. The lower end 620 of the casing section 17 is circular in section.

The profiled portion 623 of the liner 622 is expanded in a similar fashion to the liner 22 described above, to bring the liner into contact with the lower end 620 of the casing section 617. During this expansion, flutes 626 defined by the profiled portion 623 are partially or fully closed and the liner 622 is sealed by cement or other means, as described above.

Figure 11:
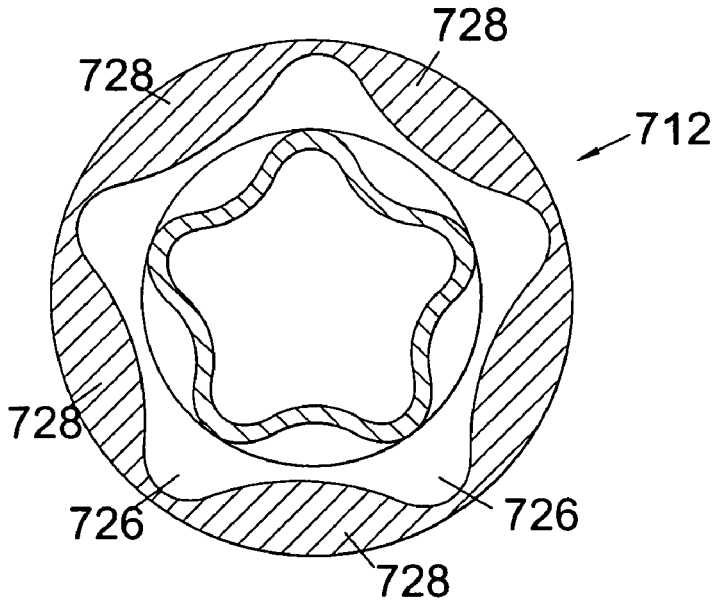
FIG. 11 is a cross-sectional view of bore-lining tubing in accordance with a still further alternative embodiment of the present invention.

FIG. 11 is a cross-sectional view of bore-lining in accordance with a still further alternative embodiment of the present invention, the tubing indicated generally by reference numeral 712.

The tubing 712 is similar to the tubing 12 of FIGS. 1A–4, except the liner 722 includes a fluted portion 723, similar to the liner 622 shown in FIG. 10.

It will be appreciated that the drawings of FIGS. 1A to 11 are schematic illustrations where some dimensions have been exaggerated for ease of reference.

Various modifications may be made to the foregoing without departing from the spirit and scope of the present invention. For example, the profiled portion of the first or second tubulars may be of any desired shape and may include, for example, at least one, typically a plurality of helical flutes, or axial or helical grooves, channels, cut-outs or the like. There may be any desired number of flow passages. The profiled portion may be corrugated or otherwise shaped and may be deformable. Accordingly, when the second tubular is deformed into contact with the first tubular, the first and second tubulars may be deformable together to expand the coupling out to the same internal diameter as the remainder of the first tubular, to allow full bore access.

Instead of expanding the liner out below the coupling between the tubulars, the liner may be maintained at an unexpanded diameter.

The flow passages may be closed by any desired means, for example, the second tubular may be deformed into sealing contact with the first tubular below the coupling, thus the first tubular may include an unprofiled part below the profiled lower end portion. Alternatively, where the first tubular profiled lower end portion is also deformable, the flow passages may be closed by deforming the profiled lower end portion out to a substantially circular section. Alternatively, seal means may be provided, either run-in from surface following location of the second tubular in the first tubular and after the initial partial expansion and cementing of the second tubular, or seal means may be provided as part of the first or second tubulars and subsequently activated when required to close the flow passages.

The second tubular may be of any suitable tubing type which allows the required expansion.

The profiled portion of the first tubular may be provided at any desired location along a length of the first tubular.

It will be understood that the second tubular may be hung or suspended within the first tubular by any suitable means such as by a string extending to surface or to a hanger within the first tubular, until the second tubular has been expanded.

The first tubular, second tubular or both the first and second tubulars may be profiled downhole. Indeed, the profiled portion of the respective first or second tubular described herein may be formed in the downhole environment. This may be achieved by expanding or otherwise shaping the respective tubular downhole, such as a lower or deepest section of casing (the casing "shoe") or an upper end of the liner, or a point along a length of the casing or liner.

For example, an expansion tool such as a cone or mandrel having a profile similar to the desired shape of the respective profile may be run-in to expand and thus profile the respective tubular. To allow this, the tubular may include a restricted bore portion which is subsequently profiled, or the expansion tool may be compliant for movement to an expansion configuration to profile the tubing.

In an alternative embodiment, the second tubular may be located downhole, expanded and then profiled. This may be achieved in successive procedures or runs of an expansion tool and a shaped, profiling cone or mandrel. Alternatively, the second tubular may be expanded and profiled in a single run or procedure, for example, a combination expansion/profiling tool may be used to expand and then profile the second tubular, or a profiling tool may be coupled to an expansion tool to profile the tubular immediately after expansion by the expansion tool.

The invention claimed is:

1. A method of lining a drilled bore, the method comprising the steps of:

providing a first tubular having an internally profiled portion;

locating the first tubular in the bore;

providing an expandable, second tubular inside the first tubular;

locating the second tubular in the bore overlapping the profiled portion of the first tubular; and expanding a portion of the second tubular to create a coupling including a flow passage within the profiled portion of the first tubular and the second tubular.

2. A method as claimed in claim 1, wherein the expandable, second tubular having an external diameter less than the internal diameter of the first tubular.

3. A method as claimed in claim 2, further comprising sealing the second tubular to the first tubular by expanding part of an upper end portion of the second tubular located above said profiled portion into sealing contact with a wall of the first tubular, to close the flow passage.

4. A method as claimed in claim 2, further comprising sealing the second tubular to the first tubular by expanding part of an upper end portion of the second tubular located below said profiled portion into sealing contact with a wall of the first tubular, to close the flow passage.

5. A method as claimed in claim 1, comprising expanding the portion of the second tubular into contact with the first tubular to create the coupling.

6. A method as claimed in claim 1, comprising providing an expandable, second tubular having a profiled portion.

7. A method as claimed in claim 6, comprising expanding the profiled portion of the second tubular to create the coupling.

8. A method as claimed in claim 7, comprising expanding the profiled portion of the second tubular into contact with the first tubular.

9. A method as claimed in claim 1, comprising expanding an upper end portion of the second tubular.

10. A method as claimed in claim 1, comprising flowing fluid via said flow passage, and then sealing the second tubular to the first tubular.

11. A method as claimed in claim 1, the first tubular having the profiled only at a lower end portion.

12. A method as claimed in claim 1, comprising creating a coupling between the first and second tubulars to provide a hanging support for the second tubular.

13. A method as claimed in claim 1, further comprising circulating cement into an annulus between the second tubular and a wall of the bore and displacing fluid from the annulus via the flow passage.

14. A method as claimed in claim 1, further comprising expanding the second tubular to a larger diameter below the coupling whilst maintaining the flow passage open.

15. A method as claimed in claim 1, further comprising expanding the second tubular to an internal diameter substantially the same as an internal diameter of the first tubular.

16. A method as claimed in claim 1, further comprising sealing the second tubular to the first tubular to close the flow passage.

17. A method as claimed in claim 16, comprising providing a seal member between the first and second tubulars.

18. A method as claimed in claim 16, comprising sealing the second tubular to the first tubular by deforming both the first and second tubulars.

19. A method as claimed in claim 18, comprising deforming the first tubular by expansion of the portion of the second tubular into contact with the first tubular.

20. A method as claimed in claim 18, further comprising expanding the second tubular to a larger diameter below the coupling whilst maintaining said flow passage open and then sealing the second tubular to the first tubular.

21. A method as claimed in claim 16, further comprising circulating cement into an annulus between the second tubular and a wall of the bore and displacing fluid from the annulus via the flow passage prior to closing the flow passage.

22. A method as claimed in claim 1, further comprising expanding the portion of the second tubular to an internal diameter substantially equal to an internal diameter of the first tubular.

23. A method as claimed in claim 22, comprising providing a first tubular having the profiled portion of an internal diameter greater than an internal diameter of a remainder of the first tubular, to accommodate expansion of the second tubular.

24. A method as claimed in claim 22, further comprising circulating cement into an annulus between the second tubular and a wall of the bore and displacing fluid from the annulus via the flow passage.

25. A method as claimed in claim 22, further comprising sealing the second tubular to the first tubular to close the flow passage.

26. A method as claimed in claim 1, further comprising expanding the second tubular from the top-down.

27. A method as claimed in claim 1, further comprising expanding the second tubular from the bottom-up.

28. A method as claimed in claim 1, further comprising expanding the second tubular to a larger diameter below the coupling whilst maintaining said flow passage open, and then sealing the second tubular to the first tubular to close the flow passage.

29. A method as claimed in claim 1, comprising profiling at least part of the first tubular prior to location of the second tubular in the bore.

30. A method as claimed in claim 29, comprising shaping the first tubular to define the profiled portion.

31. A method as claimed in claim 29, comprising at least partly expanding a portion of the first tubular.

32. A method as claimed in claim 29, comprising forming at least one flute in the first tubular.

33. A method as claimed in claim 1, comprising profiling at least part of the second tubular following location of the second tubular in the bore.

34. A method as claimed in claim 33, comprising profiling the second tubular on expansion.

35. A method as claimed in claim 33, comprising expanding the second tubular and then profiling at least part of the second tubular.

36. A method as claimed in claim 35, comprising expanding and then profiling the second tubular in a single procedure.

37. A method as claimed in claim 35, comprising expanding and then profiling the second tubular in two separate procedures.

38. A method as claimed in claim 1, comprising expanding the second tubular to create a flow passage between an inner wall of the first tubular and an outer wall of the second tubular.

39. A method as claimed in claim 1, comprising profiling at least part of the first tubular following location of the first tubular in the bore and prior to location of the second tubular in the bore, and then profiling at least part of the second tubular on expansion.

40. The method of claim 1, wherein the first tubular has a first length with the internally profiled portion and a second length with a non-profiled inner surface.

41. The method of claim 1, wherein the profiled portion includes substantially longitudinal profiles.

42. Bore-lining tubing comprising:

a first tubular having an internally profiled portion; and an expandable, second tubular, wherein a coupling between an expanded portion of the second tubular and the profiled portion of the first tubular surrounding the expanded portion, includes at least one flow passage alone the profiled portion after expansion of the second tubular.

43. Bore-lining tubing as claimed in claim 42, wherein the expandable, second tubular extends from the first tubular and overlaps the profiled portion.

44. Bore-lining tubing as claimed in claim 43, wherein the coupling is formed between an upper end portion of the second tubular expanded into contact with the profiled portion of the first tubular.

45. Bore-lining tubing as claimed in claim 43, wherein the profiled portion of the first tubular and a remainder of the first tubular define respective internal diameters, and wherein the internal diameter of the profiled portion is less than the internal diameter of the remainder of the first tubular.

46. Bore-lining tubing as claimed in claim 45, wherein the profiled portion of the first tubular includes at least one channel defining at least part of said flow passage.

47. Bore-lining tubing as claimed in claim 43, wherein the profiled portion of the first tubular and a remainder of the first tubular define respective internal diameters, and wherein the internal diameter of the profiled portion is greater than the internal diameter of the remainder of the first tubular.

48. Bore-lining tubing as claimed in claim 47, wherein the profiled portion of the first tubular and a remainder of the first tubular define respective external diameters, and wherein the external diameter of the profiled portion is greater than the external diameter of the remainder of the first tubular.

49. Bore-lining tubing as claimed in claim 47, wherein the profiled portion of the first tubular includes at least one channel defining at least part of said flow passage.

50. Bore-lining tubing as claimed in claim 43, wherein the profiled portion of the first tubular includes at least one channel defining at least part of said flow passage.

51. Bore-lining tubing as claimed in claim 42, wherein the second tubular is adapted to be expanded into contact with the first tubular.

52. Bore-lining tubing as claimed in claim 42, wherein the second tubular comprises a profiled portion.

53. Bore-lining tubing as claimed in claim 52, wherein the profiled portion of the second tubular is adapted to be expanded to create the coupling.

54. Bore-lining tubing as claimed in claim 53, wherein the profiled portion of the second tubular is adapted to be expanded into contact with the first tubular.

55. Bore-lining tubing as claimed in claim 42, wherein the first tubular comprises the profiled portion and wherein the second tubular also comprises a profiled portion, the profiled portion of the second tubular adapted to be expanded to create the coupling.

56. Bore-lining tubing as claimed in claim 42, comprising a seal member between the first and second tubulars for closing the flow passage.

57. Bore-lining tubing as claimed in claim 42, wherein the flow passage is for the flow of fluid via said passage.

58. Bore-lining tubing as claimed in claim 42, wherein the first tubular comprises the profiled portion only at a lower end portion.

59. Bore-lining tubing as claimed in claim 42, wherein the second tubular is adapted to be expanded at a level below the coupling.

60. Bore-lining tubing as claimed in claim 42, wherein the second tubular is adapted to be expanded to define an internal diameter substantially equal to an internal diameter defined by the first tubular.

61. Bore-lining tubing as claimed in claim 42, wherein the expandable, second tubular comprises an expandable solid tubular.

62. Bore-lining tubing as claimed in claim 42, wherein the first tubular includes at least one channel defining at least part of said flow passage.

63. Bore-lining tubing as claimed in claim 62, wherein at least part of an inner wall of the first tubular defines an open-sided channel.

64. Bore-lining tubing as claimed in claim 63, wherein the open-sided channel, together with the second tubular, defines the flow passage.

65. Bore-lining tubing as claimed in claim 62, wherein the channel comprises a closed-sided channel.

66. Bore-lining tubing as claimed in claim 42, wherein the first tubular includes a plurality of channels around an internal circumference of the tubular, each channel defining at least part of a respective separate flow passage between the first and second tubulars.

67. Bore-lining tubing as claimed in claim 42, wherein the flow passage extends substantially axially with respect to the first tubular.

68. Bore-lining tubing as claimed in claim 42, wherein the flow passage extends substantially helically with respect to the first tubular.

69. Bore-lining tubing as claimed in claim 42, wherein the first tubular includes the profiled portion which is profiled internally and externally and is deformable to close the flow passage by expansion of the second tubular.

70. Bore-lining tubing as claimed in claim 69, wherein the profiled portion of the first tubular is corrugated.

71. Bore-lining tubing as claimed in claim 42, wherein the flow passage is provided between an inner wall of the first tubular and an outer wall of the second tubular.

72. The bore-lining tubing of claim 42, wherein the second tubular has an outer diameter that is smaller than an interior diameter of the first tubular.

73. A method of lining a drilled bore, comprising:

providing a first tubular having an internally profiled portion and a round outer diameter;

thereafter, locating the first tubular in the bore;

providing an expandable, second tubular inside the first tubular;

locating the second tubular in the bore overlapping the profiled portion of the first tubular; and expanding a portion of the second tubular to create a coupling including a flow passage within the profiled portion of the first tubular and the second tubular.

74. The method of claim 73, wherein the profiled portion includes substantially longitudinal profiles.

75. Apparatus for lining a bore, comprising:

a first tubular having a first length with an internal profile and a second length with a non-profiled inner surface; and an expandable, second tubular disposed at least partially within the first tubular, wherein a coupling between an expanded portion of the second tubular and the profiled portion of the first tubular includes at least one flow passage along the internal profile after expansion of the second tubular.

76. The method of claim 75, wherein the internal profile is substantially longitudinal.

* * * * *